US008458828B2

(12) United States Patent
Lake

(10) Patent No.: US 8,458,828 B2
(45) Date of Patent: Jun. 11, 2013

(54) FOLDABLE CRIB

(75) Inventor: Jon Christopher Lake, Sunnyvale, CA (US)

(73) Assignee: iLinko Ltd., Quarry Bay (HK)

( * ) Notice: Subject to any disclaimer, the term of this patent is extended or adjusted under 35 U.S.C. 154(b) by 119 days.

(21) Appl. No.: 12/890,938

(22) Filed: Sep. 27, 2010

(65) Prior Publication Data

US 2012/0073044 A1 Mar. 29, 2012

(51) Int. Cl.
*A47D 7/00* (2006.01)

(52) U.S. Cl.
USPC ..... 5/99.1; 5/93.1; 5/93.2

(58) Field of Classification Search
USPC ..... 5/99.1, 93.1, 177, 663, 98.1
See application file for complete search history.

(56) References Cited

U.S. PATENT DOCUMENTS 3,800,341 A * 4/1974 Davanzo ..... 5/99.1
4,651,367 A * 3/1987 Osher et al. ..... 5/99.1
4,765,004 A * 8/1988 Kessel ..... 5/93.1
6,651,275 B1 * 11/2003 Rummell ..... 5/99.1
6,817,046 B1 * 11/2004 Srour et al. ..... 5/99.1
6,907,627 B2 * 6/2005 Waldman et al. ..... 5/99.1
7,587,774 B2 * 9/2009 Mayes et al. ..... 5/655
2004/0244110 A1 * 12/2004 Waldman et al. ..... 5/99.1
2007/0101493 A1 * 5/2007 Campbell et al. ..... 5/99.1

* cited by examiner

*Primary Examiner* — Robert G Santos
*Assistant Examiner* — Brittany Wilson
(74) *Attorney, Agent, or Firm* — Swanson & Bratschun, L.L.C.

(57) ABSTRACT

A foldable crib movable between a folded position and an open position is disclosed. The foldable crib comprises a first crib end; a second crib end; a first connecting member joining the first end to the second end, wherein the first connecting member is configured to be foldable; and a second connecting member joining the first end to the second end, wherein the second connecting member is configured to be foldable. When the crib is in an open position, the first connecting member and the second connecting member are generally unfolded. When the crib is in a folded position, the first connecting member and the second connecting member are folded.

11 Claims, 15 Drawing Sheets

FOLDABLE CRIB

TECHNICAL FIELD

The disclosed embodiments relates to a crib, and more particularly to a foldable crib.

BACKGROUND

Cribs of varying shapes and sizes provide a safe and comfortable sleeping area for babies and infants. Existing cribs generally have a base to support a mattress, legs to raise the base to a desired height off the floor and crib sides with vertically extending bars to prevent the infant from falling off of the mattress. These existing cribs typically require a significant amount of assembly before the crib can be used. Such assembly is often difficult and complicated and either deters the purchase of the product or results in the return of the crib to the store after it is purchased and taken to the purchaser's home. Due to the relatively large size of the existing cribs, they cannot be sold as pre-assembled products. While some cribs are collapsible, these cribs still require a significant amount of assembly and mechanical aptitude, and are therefore problematic for purchasers. Therefore, existing cribs have these and other undesirable qualities.

Accordingly, there is a need for a crib that solves these and other shortcomings of existing cribs.

SUMMARY OF THE EMBODIMENTS

According to one embodiment, a foldable crib movable between a folded position and an open position is disclosed. The foldable crib comprises a first crib end; a second crib end; a first connecting member joining the first end to the second end, wherein the first connecting member is configured to be foldable; and a second connecting member joining the first end to the second end, wherein the second connecting member is configured to be foldable. When the crib is in an open position, the first connecting member and the second connecting member are generally unfolded. When the crib is in a folded position, the first connecting member and the second connecting member are folded.

In one embodiment, the first connecting member includes two panels joined by one or more hinges and the second connecting member includes two panels joined by one or more hinges.

In another embodiment, the first connecting member includes two support beam segments joined by one or more hinges and the second connecting member includes two or more support beam segments joined by one or more hinges.

According to one embodiment, a foldable crib movable between a folded position and an open position comprises a first end and a second end joined to the first end by a first connecting member and a second connecting member. The first connecting member includes a first side panel I and a first side panel II joined by a first panel hinge. The second connecting member includes a second side panel I and a second side panel II joined by a second panel hinge. The first connecting member is configured to fold inward when the first end is moved in the direction of the second end. The second connecting member is configured to fold inward when the first end is moved in the direction of the second end. The foldable crib is in a folded position with the first connecting member and the second connecting member both folded inward. The foldable crib is in an open position when the first connecting member and the second connecting member are substantially straight.

In one embodiment, when the crib is in the folded position, the first connecting member folds at the first panel hinge and the second connecting member folds at the second panel hinge. When the crib is in the open position, the first panel hinge is laterally offset from the second panel hinge.

In another embodiment, the foldable crib further comprises a mattress board. Each of the first end, the second end, the first connecting member, and the second connecting member includes one or more mattress board support rails on the interior side of the crib. The mattress board is configured to fit generally horizontally within the crib and engage the mattress board support rails.

In yet another embodiment, the foldable crib further comprises a first edge rail and a second edge rail. When the crib is in the open position, the first connecting member has a first elongate top side edge, and the second connecting member has a second elongated top side edge. The first edge rail securely engages the first top side edge of the first connecting member, and the second edge rail securely engages the second top side edge of the second connecting member.

Also within the scope of the embodiments disclosed herein is a foldable crib movable between a folded position and an open position, comprising: a first end having one or more crib legs for raising the foldable crib; a second end having one or more crib legs for raising the foldable crib; a first connecting member joining the first end to the second end, wherein the first connecting member includes a first side panel I and a first side panel II, the first side panel I foldably joined to the first side panel II at a first fold line; and a second connecting member joining the first end to the second end, wherein the second connecting member includes a second side panel I and a second side panel II, the second side panel I foldably joined to the second side panel II at a second fold line. When the crib is in the open position, the first fold line and the second fold line are laterally offset a predetermined distance from each other. When the crib is in the closed position, the first end and the second end are proximate to each other. The first side panel I and first side panel II of the first connecting member form a first folded panel. The second side panel I and second side panel II of the second connecting member form a second folded panel. The first folded panel and the second folded panel are nested within the crib proximate to each other between the first end and the second end.

Still other embodiments will become readily apparent to those skilled in the art from the following detailed description, wherein embodiments are described by way of illustration. As will be realized, the embodiments are capable of other and different variations and its several details are capable of modifications in various respects, all without departing from the spirit and the scope of the present disclosure.

DETAILED DESCRIPTION

Unless otherwise indicated, all numbers expressing quantities of ingredients, dimensions reaction conditions and so forth used in the specification and claims are to be understood as being modified in all instances by the term "about".

In this application and the claims, the use of the singular includes the plural unless specifically stated otherwise. In addition, use of "or" means "and/or" unless stated otherwise. Moreover, the use of the term "including", as well as other forms, such as "includes" and "included", is not limiting. Also, terms such as "element" or "component" encompass both elements and components comprising one unit and elements and components that comprise more than one unit unless specifically stated otherwise.

In the following description, reference is made to the accompanying drawings where, by way of illustration, specific embodiments are shown. It is to be understood that other embodiments may be used as structural and other changes may be made without departing from the scope of the present disclosure. Also, the various embodiments and aspects from each of the various embodiments may be used in any suitable combinations. Accordingly, the drawings and detailed description are to be regarded as illustrative in nature and not as restrictive.

Generally, the embodiments disclosed herein are directed to a foldable crib that folds compactly for efficient shipping and storage and can be expanded into an open position quickly, easily and with relatively little assembly. The crib may be assembled into a usable configuration without the use of any tools. The crib may also be transitioned back and forth between the open position and the folded position easily and without the use of any tools.

It should be noted that, for ease of understanding, like elements of the disclosed embodiments are denoted with like reference numbers on the figures throughout the disclosure. Also, for clarity, similar elements are not identified with reference numbers in all of the figures, even though these similar elements appear in multiple figures. It will be apparent that these elements have the properties as described with reference to other figures.

Figure 1:
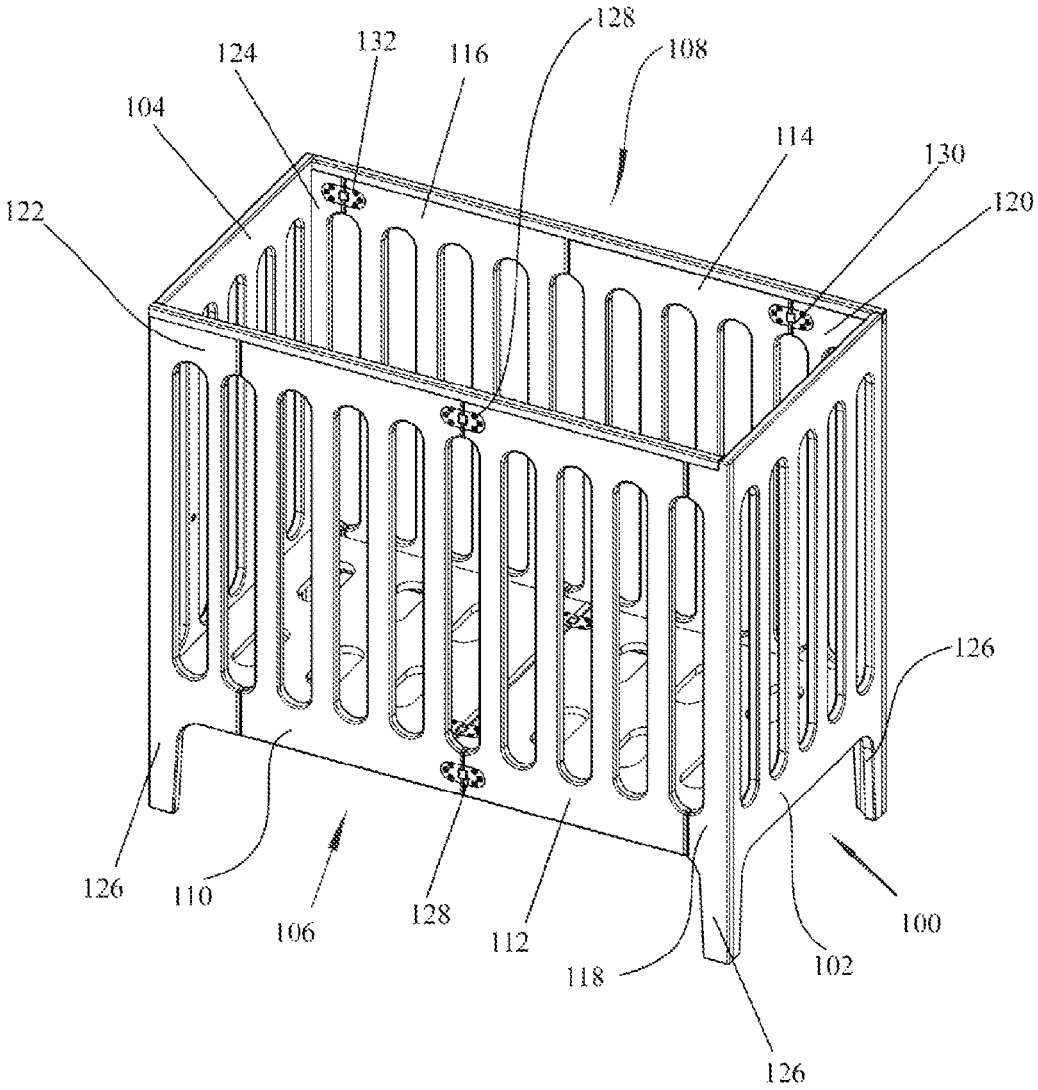
FIG. 1 is a perspective view of a foldable crib in an open position, according to one embodiment.

Referring to FIG. 1, a perspective view of a foldable crib in an open position is shown. The foldable crib 100 includes a first end 102, a second end 104, a first side wall 106, and a second side wall 108. The first side wall 106 includes a first side panel I 110 and a first side panel II 112. The second side wall 108 includes a second side panel I 114 and a second side panel II 116. The first end 102 is joined to, or integrally formed with, a first side end panel I 118 and a second side end panel I 120. The second end 104 is joined to, or integrally formed with, a first side end panel II 122 and a second side end panel II 124. The first end 102 includes two legs 126, and the second end 104 includes two legs 126 (one not shown in FIG. 1). However, one or more legs may be used to raise the crib from the ground surface. In the illustrated embodiment, the first end 102 is generally similar to the second end 104, rotated into a position so that the first end 102 opposes the second end 104. Also, the first side wall 106 is generally similar to the second side wall 108, rotated to face each other.

The first side panel I 110 and the first side panel II 112 on the first side wall 106 are joined by panel hinges 128. The first side panel II 112 is joined to the first side end panel I 118 by first end hinges (not shown). The first side panel I 110 is joined to the first side end panel II 122 by second end hinges (not shown). The second side panel I 114 and the second side panel II 116 on the second side wall 108 are joined by panel hinges (not shown). The second side panel I 114 is joined to the second side end panel I 120 by first end hinges 130 (only one shown). The second side panel II 116 is joined to the second side end panel II 124 by second end hinges 132 (only one shown). In the embodiment illustrated in FIG. 1, the panel hinges 128 are located on the outside of the crib 100 and the end hinges are located on the inside of the crib. However, the hinges may be located in any suitable position, or integrally formed within the panels, that allows the proper movement in accordance with the disclosed embodiments. According to various disclosed embodiments, the location of the hinges on the first side wall 106 relative to the location of the hinges on the second side wall 108 also allow for proper movement in accordance with various disclosed embodiments, as is further described with reference to FIGS. 3 to 5.

Figure 2:
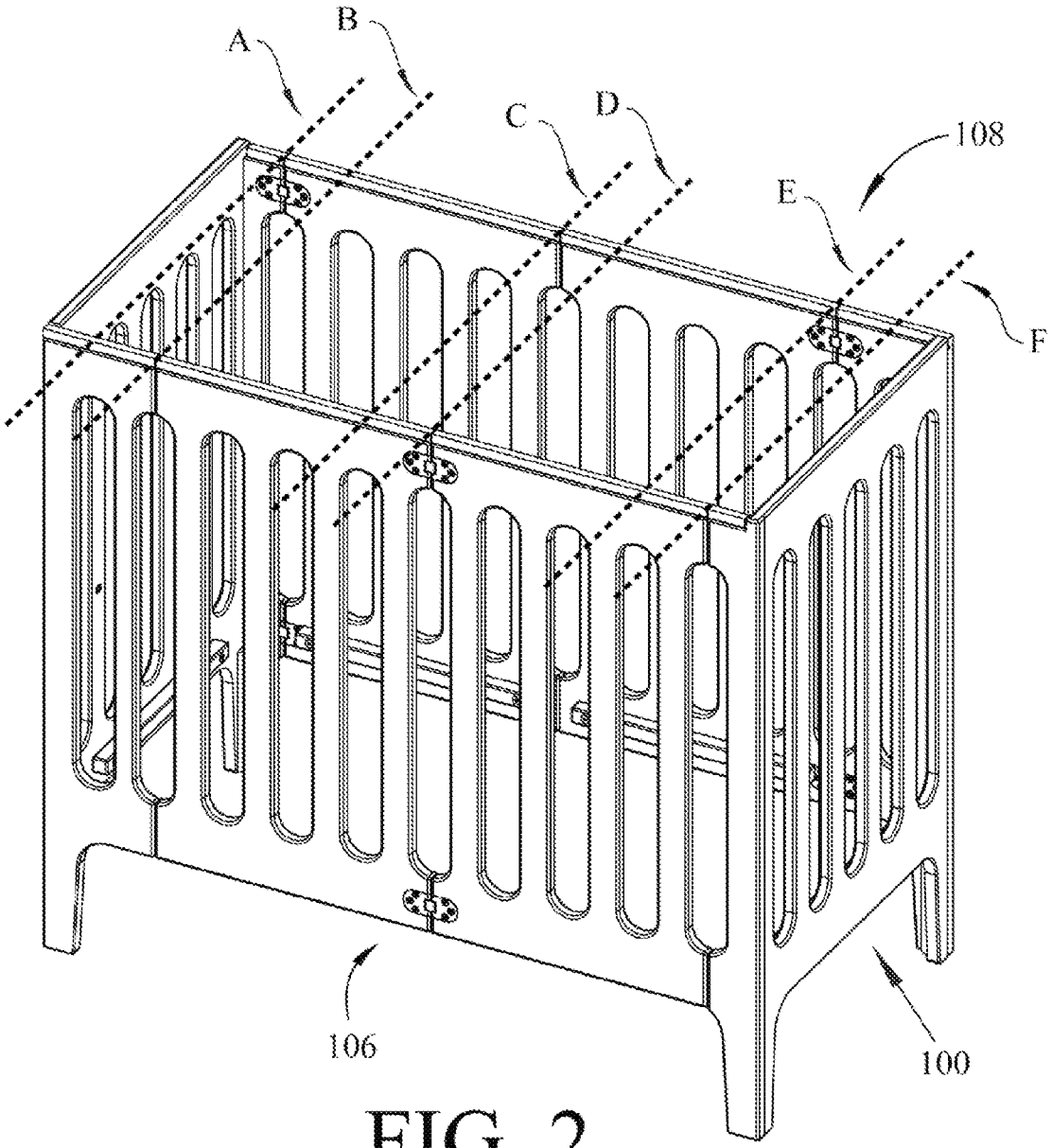
FIG. 2 is a perspective view of the foldable crib shown in FIG. 1 in an open position, without mattress board, according to one embodiment.

FIG. 2 is a perspective view of the foldable crib shown in FIG. 1 in an open position, without mattress board, according to an embodiment disclosed herein. Five hinge lines, line A, line B, line C, line D, line E, and line F, are identified in FIG. 2. The position of these five hinge lines provides for the compact folding of the foldable crib 100, as is further illustrated in FIGS. 3 to 5.

While hinges are shown and described with respect to certain embodiments, other coupling devices and methods can be used to join the various parts and panels of a crib made in accordance with other embodiments. However, hinges are only one example suitable devices used to join the various panels and parts of the foldable crib. Therefore, the "hinge lines" may also be referred to as "fold lines" indicating the location where a bend or fold between two adjoining panels or parts may occur. Also, while a certain number of hinges are illustrated, one or more hinges, or other suitable coupling devices, may be used.

Figure 3:
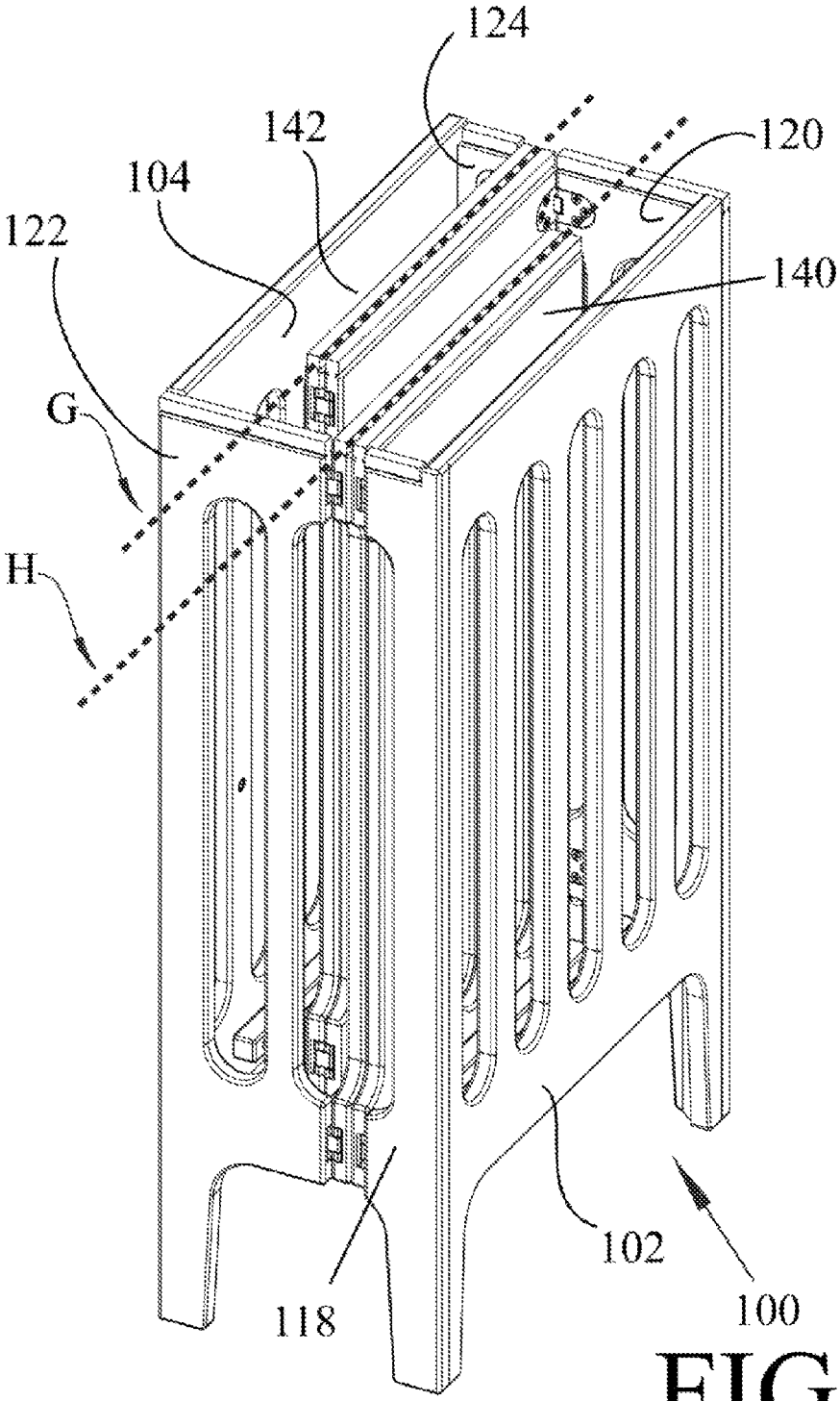
FIG. 3 is a perspective view of the foldable crib shown in FIG. 1 in a folded position, according to an embodiment.

Referring to FIG. 3, the foldable crib 100 is shown in a folded position. As can be seen in the figures, the length of the crib 100 from the first end 102 to the second end 104 is significantly reduced in the folded position. The first side panel I 110 and the first side panel II 112 of the first side wall 106, in the folded position, become a first folded panel 140, and the second side panel I 114 and the second side panel II 116 of the second side wall 108 become a second folded panel 142. The first folded panel 140 and the second folded panel 142 are located generally adjacent to each other within the crib 100, in a nested configuration, between the first end 102 and the second end 104. The first folded panel is positioned at line H, which in the folded position is effectively the meeting of line B and line F (see FIG. 2), and the second folded panel is positioned at line G, which in the folded position is effectively the meeting of line A and line E (see FIG. 2).

Figure 4:
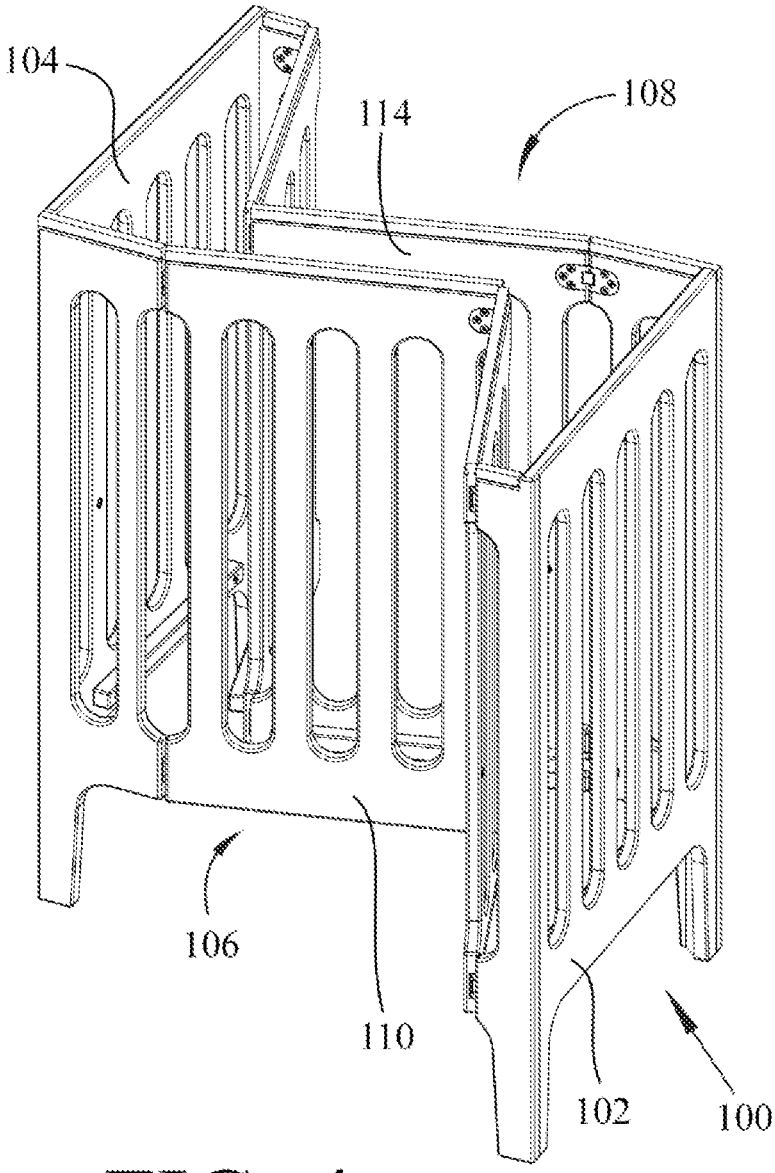
FIG. 4 is a perspective view of the foldable crib shown in FIG. 1 in a partially folded position, according to an embodiment.
Figure 5:
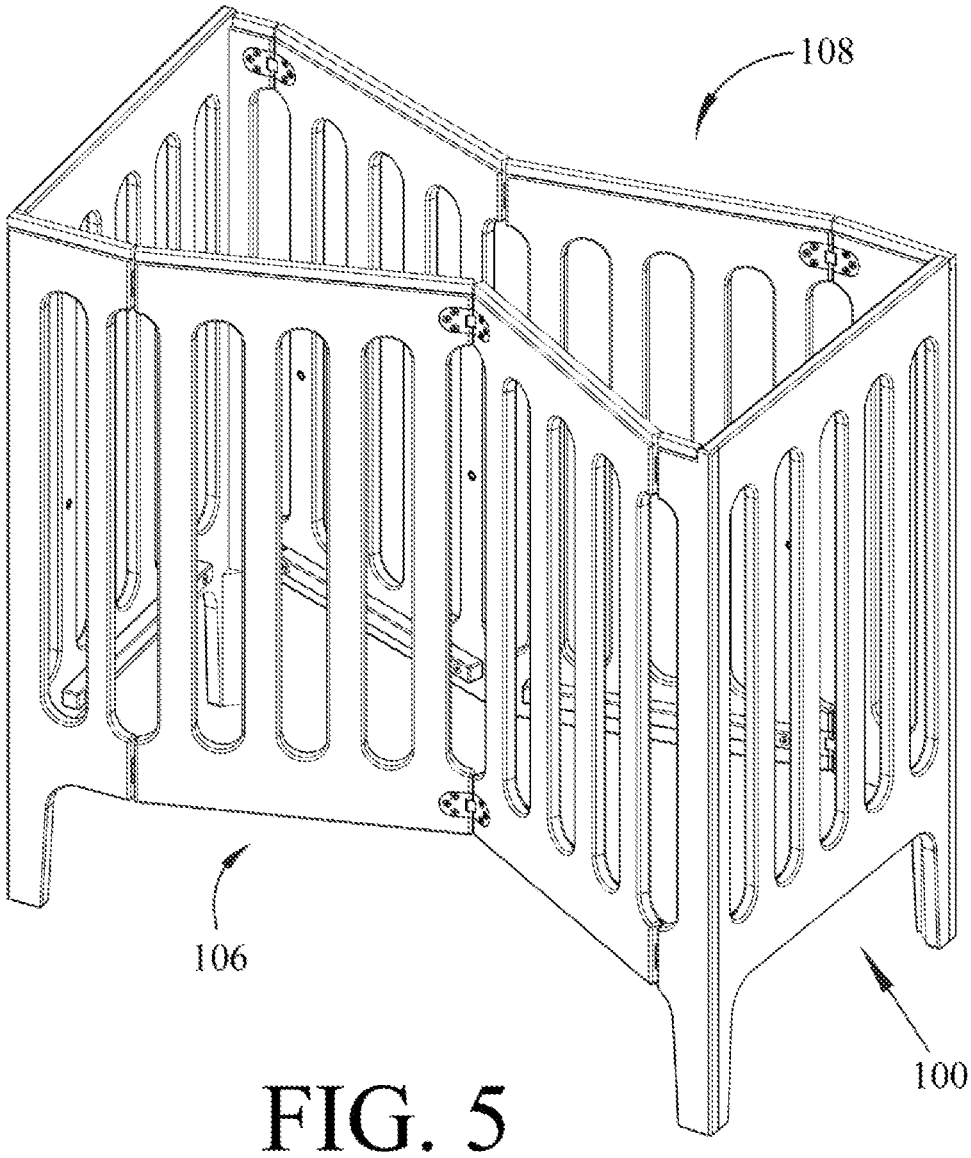
FIG. 5 is a perspective view of the foldable crib shown in FIG. 1 in a partially expanded position, according to an embodiment.

Referring now to FIGS. 3 to 5, the expanding of the foldable crib 100 from the folded position to the open position is illustrated in steps. FIG. 4 is a perspective view of the foldable crib shown in FIG. 1 in a partially folded position. To transition from the folded position shown in FIG. 3 to the open position shown in FIGS. 1 and 2, the first end 102 and the second end 104 are pulled away from each other in generally opposite directions. During the opening of the crib 100, the first side panel I 110 of the first side wall 106 slides adjacent to the second side panel I 114 of the second side wall 108 and both the first side wall 106 and the second side wall 108 begin to straighten.

FIG. 5 is a perspective view of the foldable crib shown in FIG. 1 in a partially expanded position, according to the disclosed embodiment. As the first end and second end continue to be pulled away from each other, the first side wall 106 and the second side wall 108 continue to straighten out until each of the first side wall 106 and the second side wall 108 is substantially straight. At this point when the side walls are straight, the crib 100 is in an open position. The open position, with the first side wall 106 and second side wall 108 substantially straight, is shown in FIG. 2. The transition from the open position to the folded position occurs in a similar way, where the steps as described with reference to FIGS. 3 to 5 performed in a reversed order.

Figure 6:
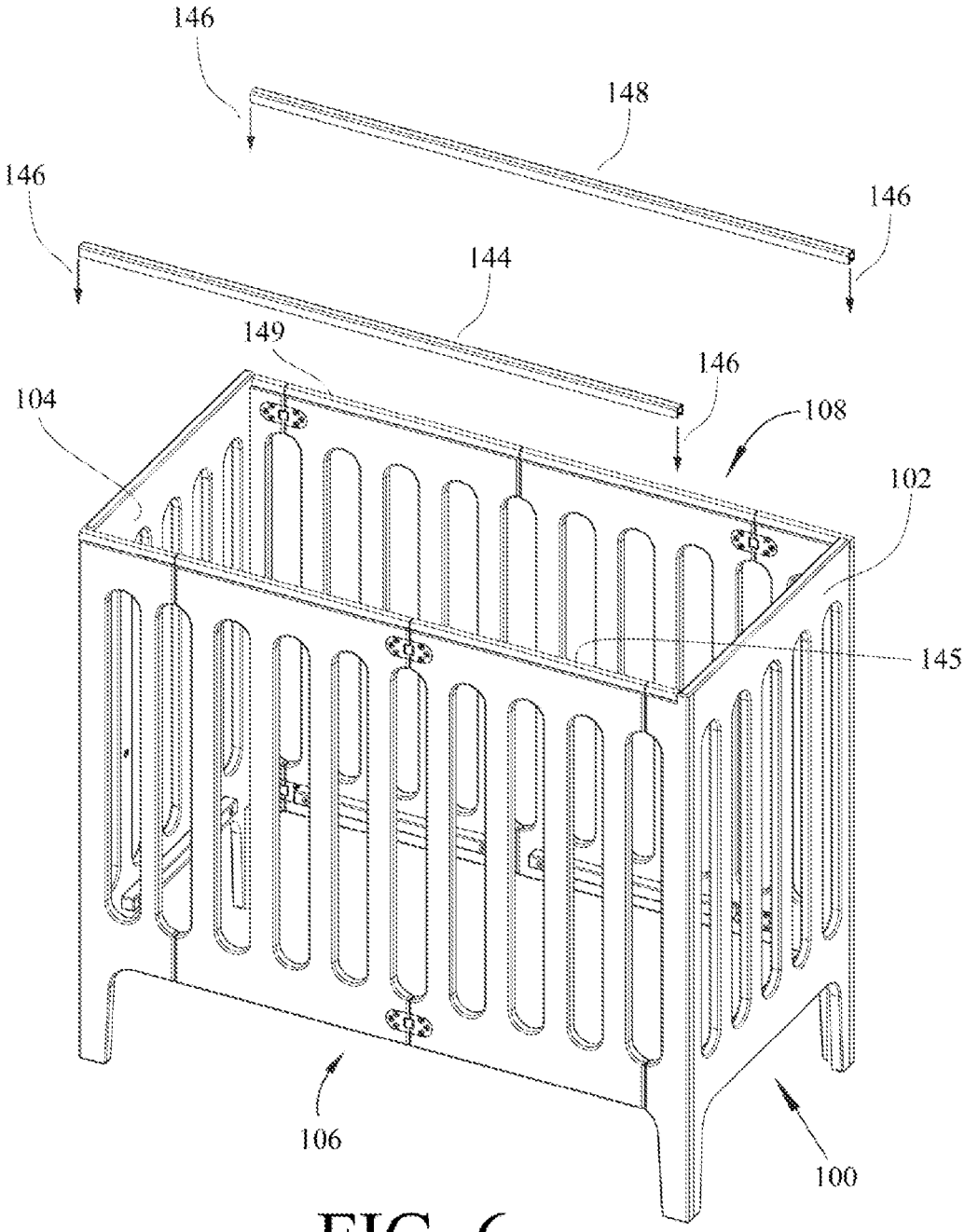
FIG. 6 is a perspective view of the foldable crib shown in FIG. 1 illustrating the application of edge rails, according to an embodiment.

FIG. 6 is a perspective view of the foldable crib shown in FIG. 2 illustrating the application of edge rails, according to an embodiment. A first edge rail 144 is placed onto a first side edge 145 in a downward direction, as indicated by direction arrows 146. A second edge rail 148 is placed onto the second side edge 149. In one embodiment, the first and second edge rails 144, 148 are substantially rigid and extend the full length of the crib from the first end 102 to the second end 104. The first and second edge rails 144, 148 may also snap into positions on their respective edges 145, 149 such that a predetermined amount of force is required to remove the edge rails. However, the edge rails are configured so that no tool is required to remove the edge rails from their respective edges. The edge rails 144, 148 assist in maintaining the first side wall 106 and the second side wall 108 of the crib 100 generally straight. The crib, in the open position, with the first edge rail 144 and the second edge rail 148 in place is shown in FIG. 7.

Any suitable means may be used to hold the edge rails 144, 148 in place. In one embodiment, each of the edge rails has a generally "U" shape that curves on top of the edge. Each edge rail includes one or more elongated ridges on the interior side of the edge rail, proximate to the opening of the edge rail. A complementary groove or channel is formed on the edge that is engaged by the one or more elongated ridges on the edge rail.

Figure 7:
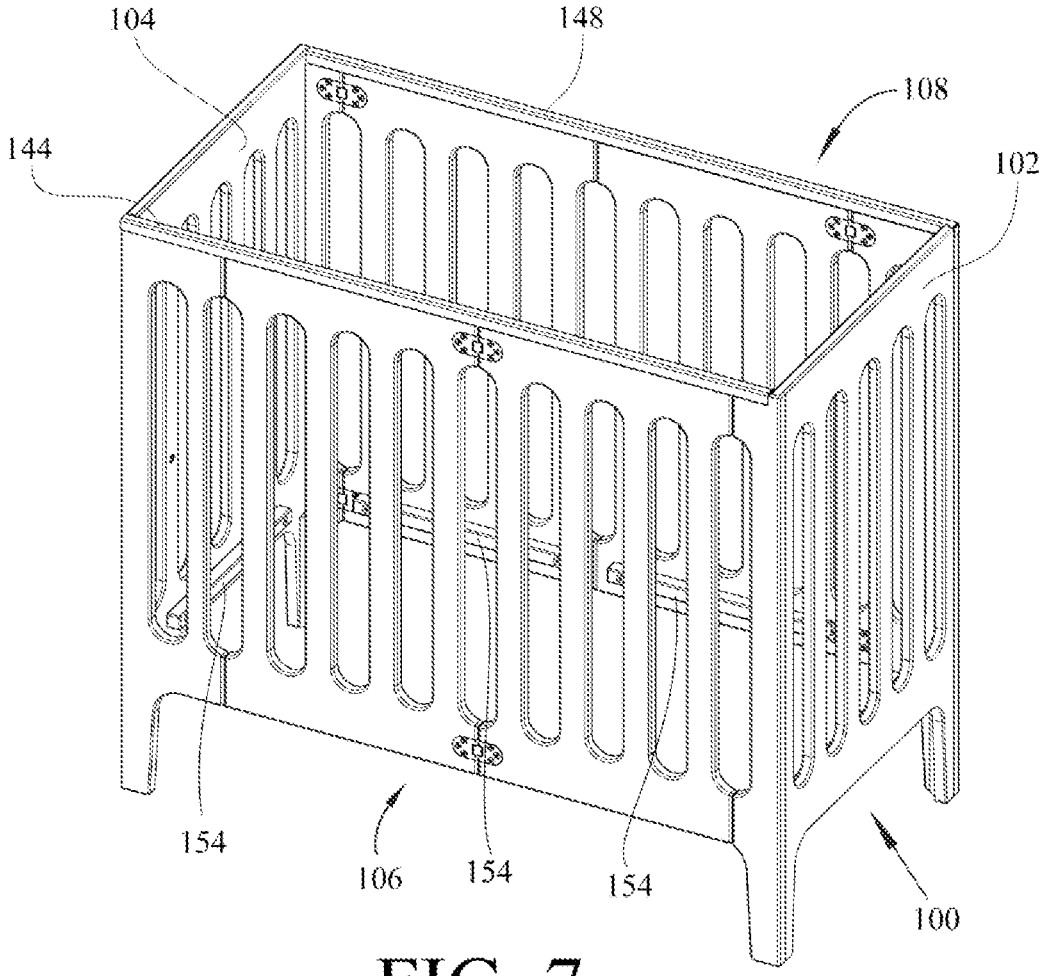
FIG. 7 is a perspective view of the foldable crib shown in FIG. 1 with edge rails in place, according to an embodiment.
Figure 8:
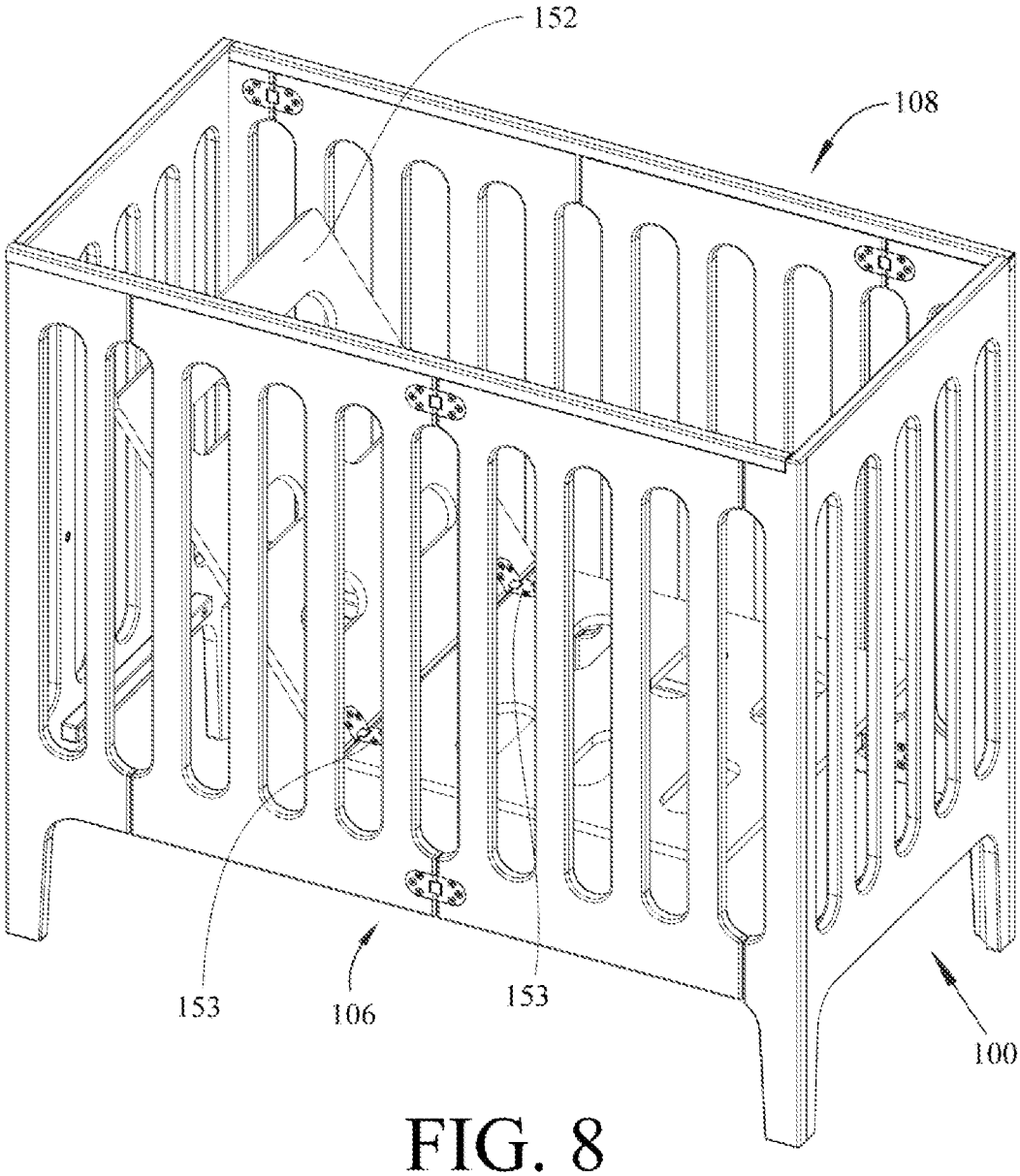
FIG. 8 is a perspective view of the foldable crib shown in FIG. 1 illustrating the insertion of a mattress board, according to an embodiment.

FIG. 8 is a perspective view of the foldable crib shown in FIG. 7 illustrating the insertion of a mattress board 152, according to an embodiment. The mattress board 152 shown in the illustrated embodiment comprised two panels joined by hinges 153 so that the mattress board 152 may be folded for even more compact and convenient storage and transportation. However, the mattress board may include one or more panels, either joined or separate from each other, that are suitable for use with the foldable crib. A plurality of board support rails 154 (partially shown in FIG. 7) are affixed to the ends and the side panels of the crib at the lower, inside portion of the crib 100. The mattress board 152, when inserted into the crib 100, rests on these board support rails 154, which provide support on all sides of the mattress board 152.

Generally, FIGS. 9 to 15 are directed to second embodiment of the foldable crib. The appearance and structure of the second embodiment are different. However, the general configuration and method of folding is similar. Accordingly, the description relating to FIGS. 1 to 8 (the first embodiment) similarly applies to the second embodiment illustrated and described with reference to FIGS. 9 to 15. The description with reference to FIGS. 9 to 15, where not otherwise stated, may also similarly apply to the first embodiment. Where the foldable crib of the first embodiment has first and second side walls that fold, the second embodiment has first and second side support beams that fold in a similar way, allowing the crib to alternate between an open position and a folded position.

Figure 9:
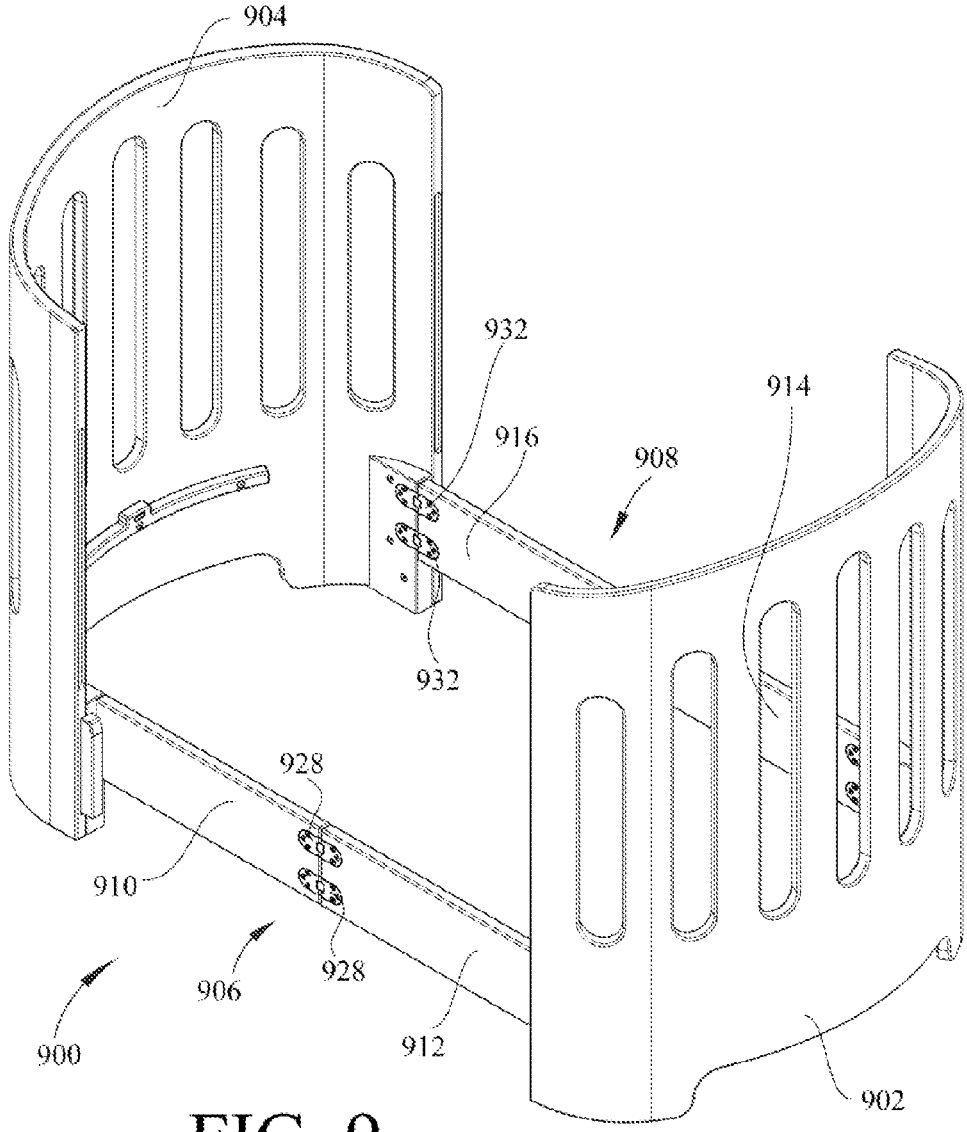
FIG. 9 is a perspective view of a foldable crib in an open position, according to another embodiment.

Referring to FIG. 9, a perspective view of a foldable crib 900 in an open position is shown, according to the second embodiment. The foldable crib 900 includes a first end 902, a second end 904, a first side support beam 906, and a second side support beam 908. The first side support beam 906 includes a first beam segment I 910 and a first beam segment II 912. The second side support beam 908 includes a second beam segment I 914 and a second beam segment II 916.

In the illustrated embodiment, the first end 902 is generally similar to the second end 904, rotated into a position so that the first end 902 opposes and faces the second end 904. Also, the first side support beam 906 is generally similar to the second side support beam 908, rotated to face each other.

The first beam segment I 910 and the first beam segment II 912 on the first side support beam 906 are joined by beam hinges 928. The first beam segment II 912 is joined to the first end 902 by end hinges (not shown). The first beam segment I 910 is joined to the second end 904 by end hinges (not shown). The second beam segment I 914 and the second beam segment II 916 on the second side support beam 908 are joined by beam hinges (not shown). The second beam segment I 914 is joined to the first end 902 by end hinges. The second beam segment II 916 is joined to the second end 904 by second end hinges 932.

In the embodiment illustrated in FIG. 9, the beam hinges (including 928) are located on the outside of the crib 900 and the end hinges (including 932) are located on the inside of the crib. However, the hinges may be located in any suitable position, or integrally formed within the panels, that allows the proper movement in accordance with the disclosed embodiments. According to various embodiments, the location of the hinges on the first side support beam 906 relative to the location of the hinges on the second side support beam 908 also allow for proper movement in accordance with the disclosed embodiments, as is further described with reference to FIGS. 11 to 15.

Figure 10:
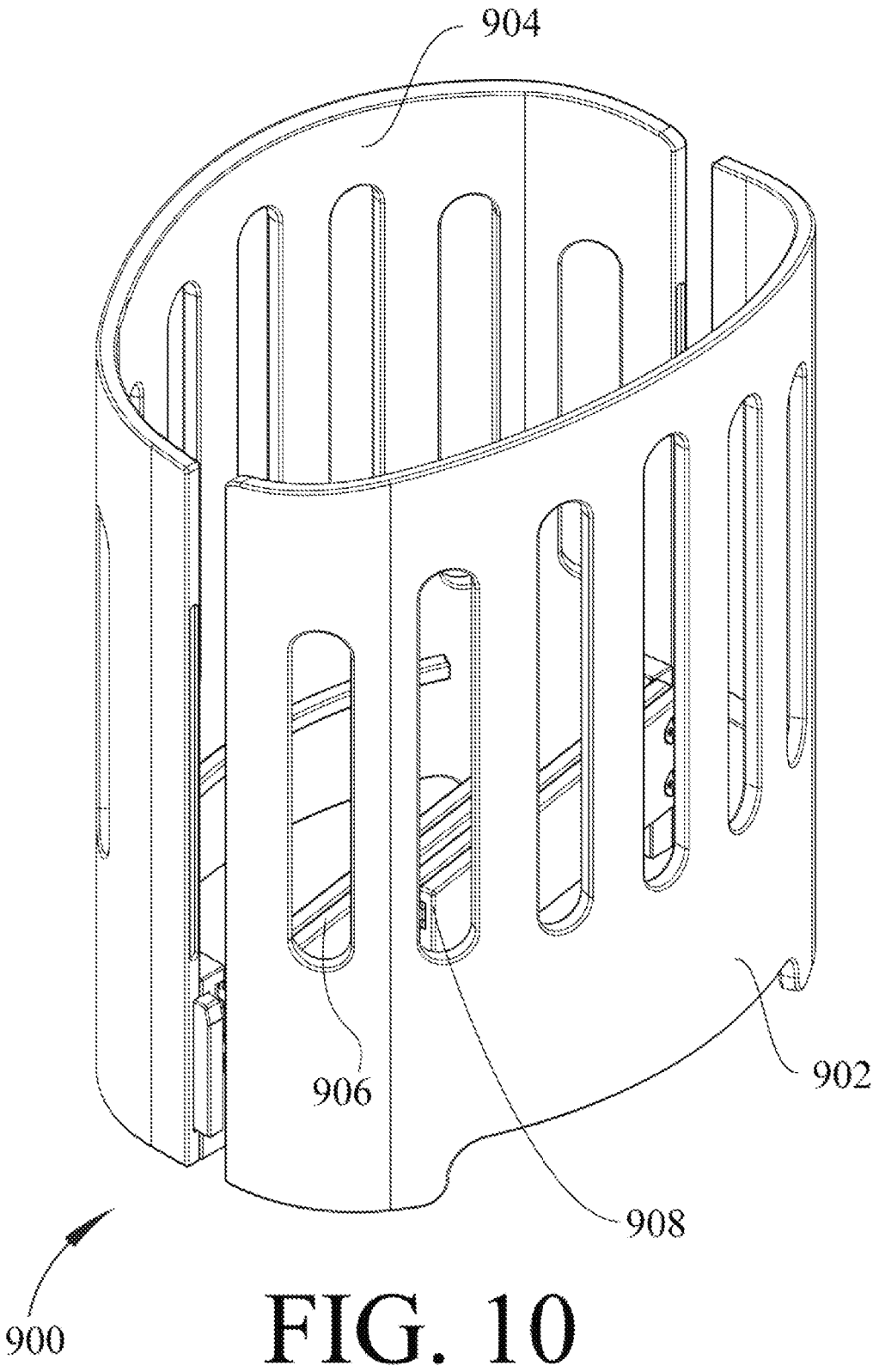
FIG. 10 is a perspective view of the foldable crib shown in FIG. 9 in a folded position, according to an embodiment.

FIG. 10 is a perspective view of the foldable crib shown in FIG. 9 in a folded position, according to one embodiment. In the folded position, the first end 902 and the second end 904 are adjacent or proximate to each other. The close proximity of the first end 902 to the second end 904 while in the folded position is due to the folded, nested configuration of the first side support beam and the second side support beam. In the folded position, the first side support beam 906 and the second side support beam 908 are folded and contained within the foldable crib 900. Accordingly, in the folded position, the crib 900 has a substantially shorter length and may occupy less space.

Figure 11:
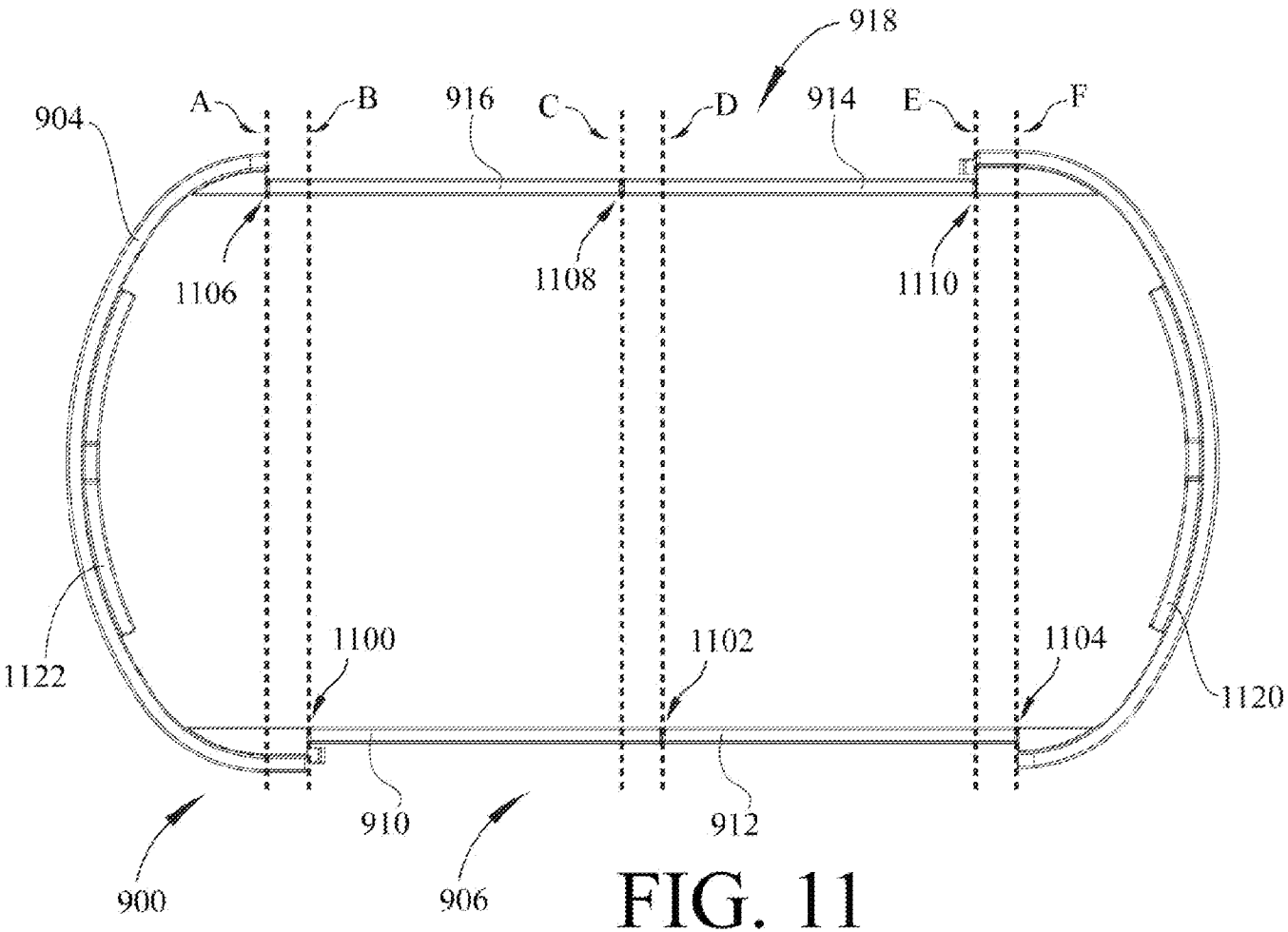
FIG. 11 is a plan view of the foldable crib shown in FIG. 9 in the open position, according to an embodiment.

FIG. 11 is a plan view of the foldable crib shown in FIG. 9 in the open position, according to one embodiment. Five hinge lines are shown, similar to those shown in FIG. 2, including line A, line B, line C, line D, line E, and line F, are identified in FIG. 11. The position of these five hinge lines provides for the compact folding of the foldable crib 900, as is further illustrated in FIGS. 11 to 15. Generally, a first hinge 1100, a second hinge 1102, and a third hinge 1104, not shown in FIG. 11 but located at the referenced positions, are aligned with hinge lines B, D, and F, respectively. Also, a fourth hinge 1106, a fifth hinge 1108, and a sixth hinge 1110 are aligned with hinge lines A, C, and E, respectively. Therefore, the first 1100, the second 1102 and the third 1104 hinges are offset from the fourth 1106, the fifth 1108, and the sixth 1110 hinges. The offset hinges therefore permit the crib 900 to occupy a nested, folded position, where the first side support beam 906 is folded and nested next to the second side support beam 908 at the interior of the crib 900. The first side support beam 906 may be positioned on either side of the second side support beam 908.

The offset hinges, as shown in FIGS. 2 and 11, permit the support beams, and also the side walls with reference to the first embodiment of the crib illustrated and described with reference to FIGS. 1 to 8, to fold generally perpendicular into the crib. However, the hinges need not be offset. The folded support beams or walls may fold in on either side of each other or at angles. The crib, when folded, may also be positioned at an angle to permit other positioning of the folded support beams or walls.

The first end 902 may include a first support ledge 1120 and the second end 904 may include a second support ledge 1122. A mattress board may be inserted to the center of the crib 900 where it rests on the first and second support ledges 1120, 1122 and the first and second side support beams 906, 908. However, other shapes and sizes of support structures may be used to support a mattress board or other support structures for locating a crib mattress.

Figure 12:
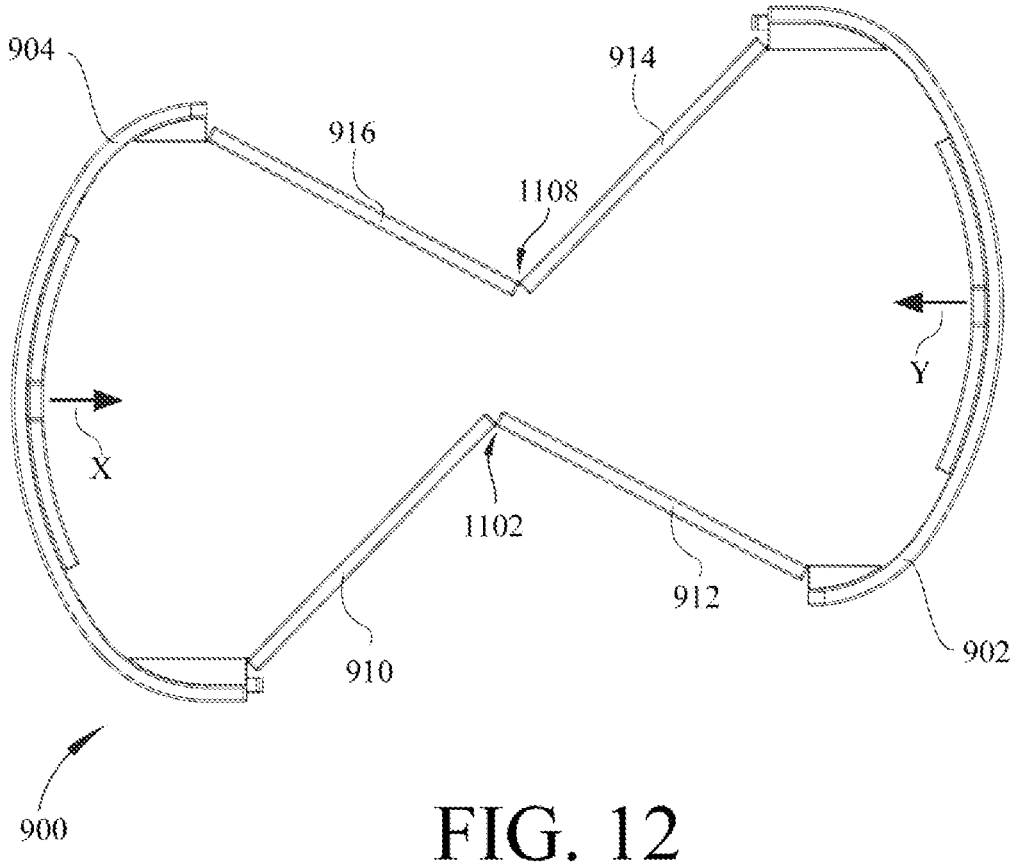
FIG. 12 is a plan view of the foldable crib shown in FIG. 9 in a partially expanded position, according to an embodiment.

FIG. 12 is a plan view of the foldable crib shown in FIG. 9 in a partially expanded position, according to one embodiment. As the first end 902 is moved in the direction indicated by arrow Y toward the second end 904 and the second end 904 is moved in the direction indicated by arrow X toward the first end, the second hinge 1102 and the fifth hinge 1108 are moved toward each other as the first side support beam 906 bends inward and the second side support beam 908 bends inward.

Figure 13:
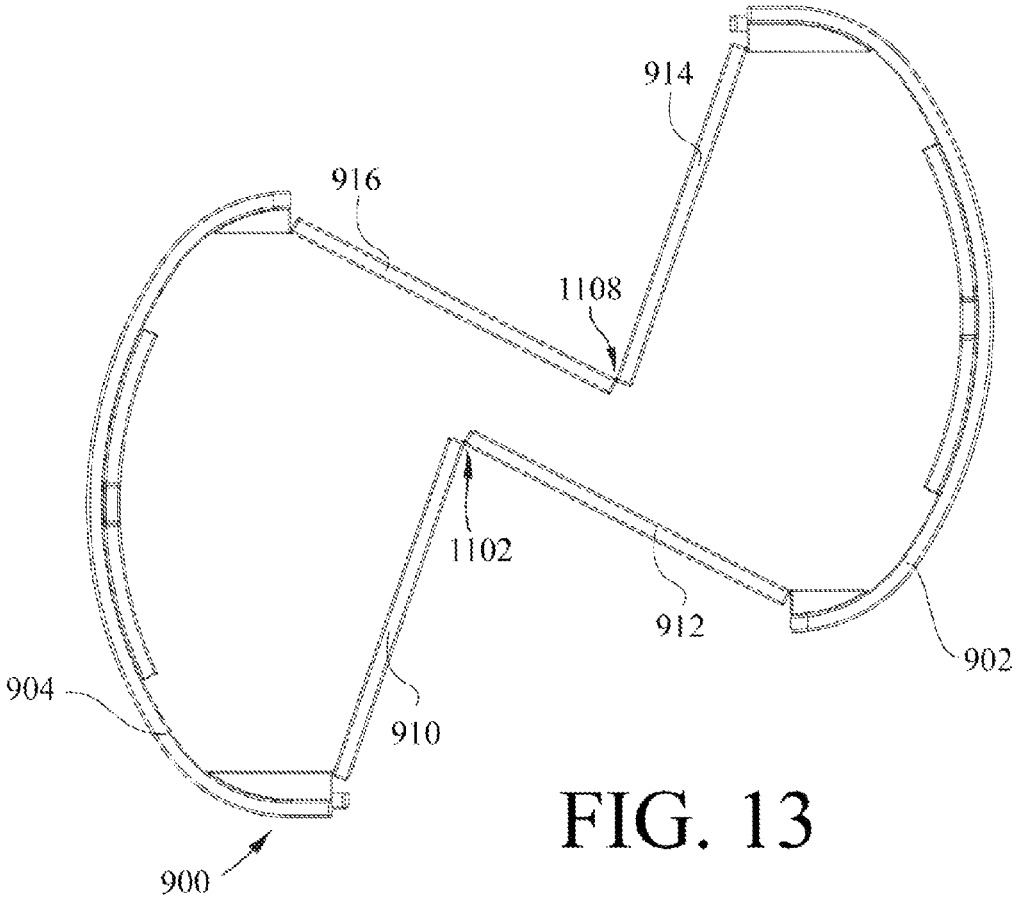
FIG. 13 is a plan view of the foldable crib shown in FIG. 9 in a partially folded position, according to an embodiment.

FIG. 13 is a plan view of the foldable crib shown in FIG. 9 in a partially folded position, according to one embodiment. In the position illustrated in FIG. 13, the crib 900 is folded slightly more than the position illustrated in FIG. 12. The second hinge 1102 is beginning to move to the side of the fifth hinge 1108.

Figure 14:
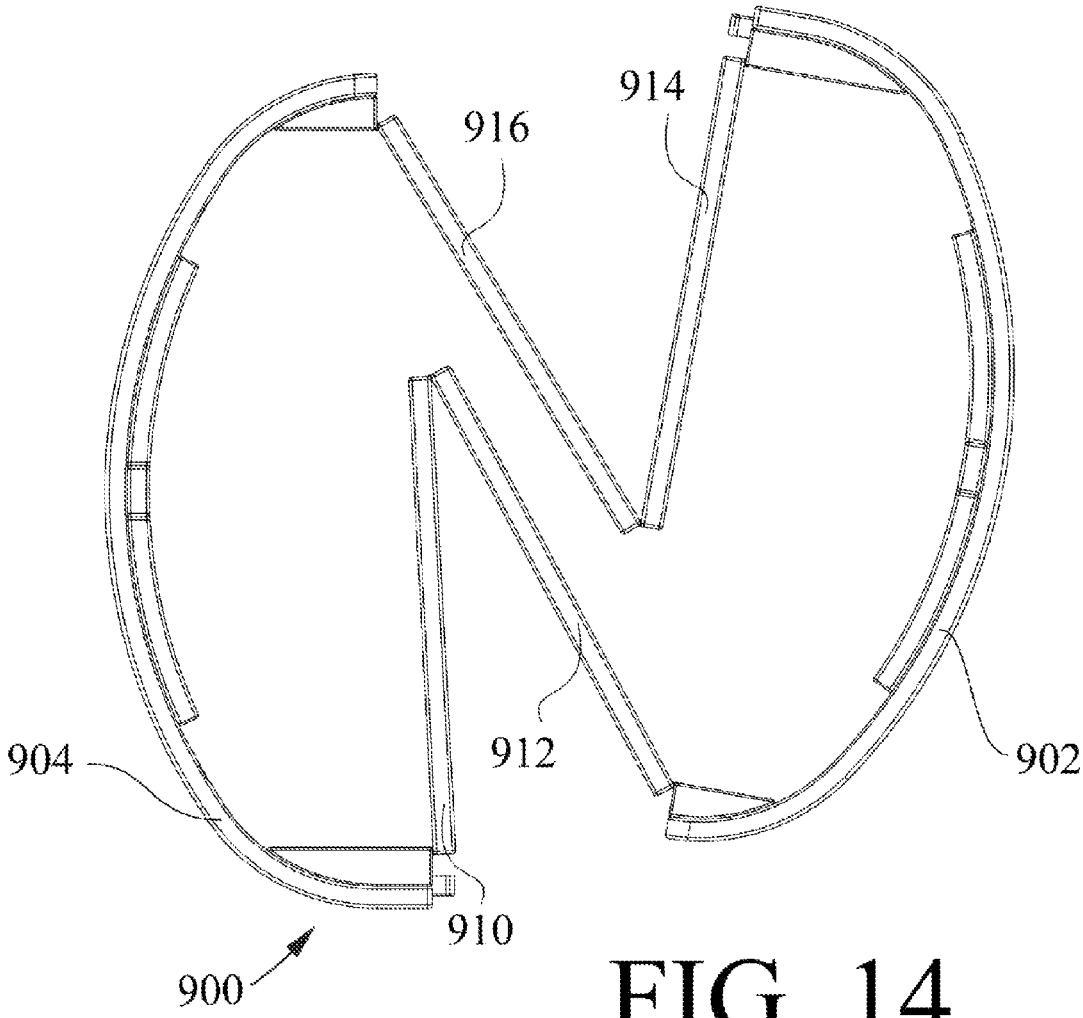
FIG. 14 is a plan view of the foldable crib shown in FIG. 9 in a partially folded position, according to an embodiment.

FIG. 14 is a plan view of the foldable crib shown in FIG. 9 in a partially folded position, according to one embodiment. In the position illustrated in FIG. 14, the crib 900 is folded slightly more than in the position illustrated in FIG. 13. The second hinge 1102 has moved past the fifth hinge 1108, and the first beam segment II 912 of the first side is located proximate to the second beam segment II 916 of the second side. In a folded position, the first beam segment II 912 of the first side will be located adjacent to the second beam segment II 916 of the second side. Alternatively, the first side support beam 906 may be positioned on the other side of the second side support beam 908, and in that case, the first beam segment I 910 of the first side will be located adjacent to the second beam segment I 914 of the second side.

Figure 15:
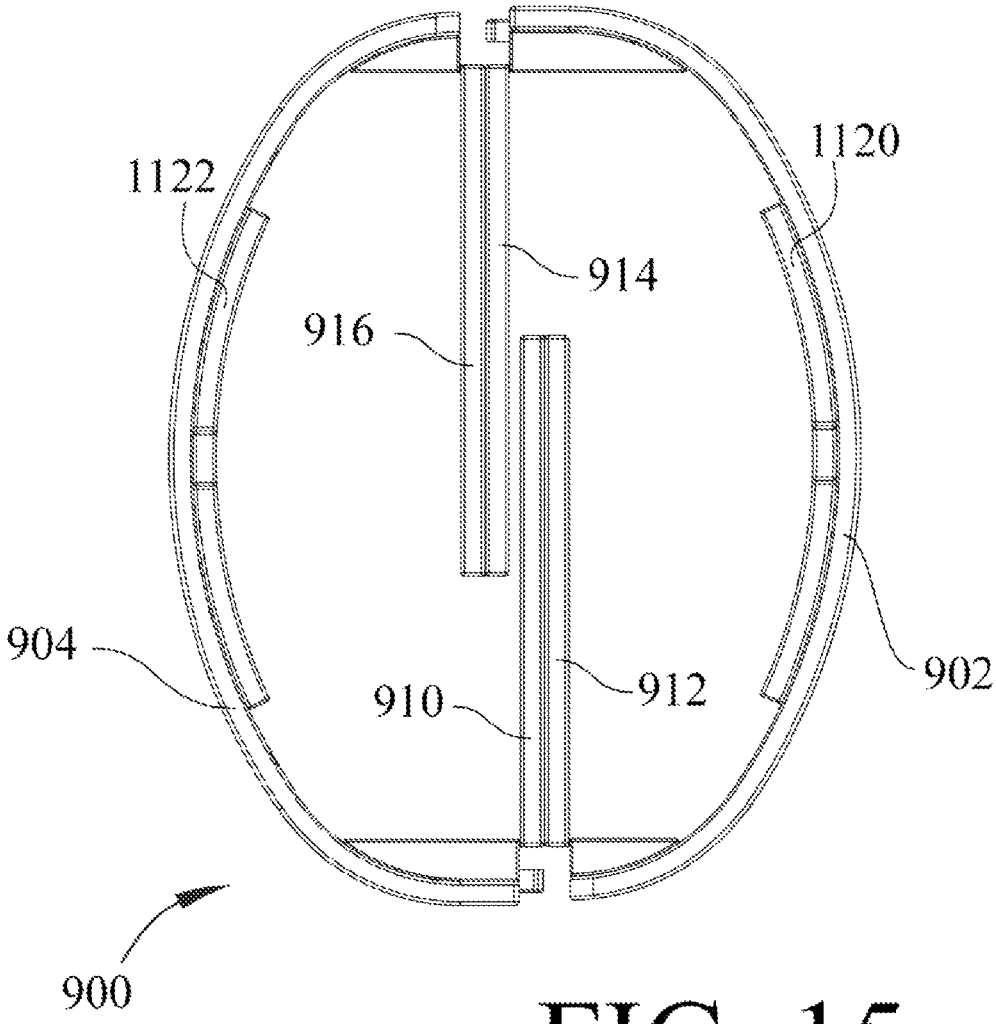
FIG. 15 is a plan view of the foldable crib shown in FIG. 9 in the folded position, according to an embodiment.

FIG. 15 is a plan view of the foldable crib shown in FIG. 9 in the folded position, according to one embodiment.

Referring generally to the embodiments of the foldable crib illustrated in FIGS. 9 to 15, the first end 902 and the second end 904 may be configured to receive side panels or side walls of the crib. The side panels may be of any suitable shape and configuration.

Referring generally to embodiments of the foldable crib illustrated and described with reference to FIGS. 1 to 15, embodiments of the foldable crib include first and second crib ends, and first and second connecting members. The "connecting members," as used herein, refer to any suitable folding connecting members, including, but not limited to, side walls and those folding connecting members which are more of supports and not "walls." The side walls are not limited to the embodiments illustrated in the figures where the side walls include slotted panels, as shown in the embodiment illustrated in FIGS. 1 to 8, or where the side walls include support beam segments, as shown in the embodiment illustrated in FIGS. 9 to 15. The side walls are foldable to the interior of the crib as the first and second crib ends are moved toward each other. In a folded position, the folded side walls are nested proximate to each other at the interior of the crib.

According to one embodiment, the side walls and the crib ends may be coupled using hinges that allow folding in predetermined directions. For example, the hinges may be positioned and/or configured to bend in only one direction such that the side walls may only fold inward and not outward.

According to the illustrated embodiments, the hinges may be offset to achieve a desired positioning of the side walls when folded. However, the hinges need not be offset. The hinges can be laterally aligned, or only some of the hinges of one side may be aligned with corresponding hinges of the other side. Also, while the panels of the side walls have generally equal width in the illustrated embodiments, other embodiments may include side walls with panels of different widths to achieve different folding configurations.

While embodiments of the foldable crib have been described with reference to specific structures and designs, variations may be incorporated without departing from the scope of the various embodiments disclosed herein. For example, while the crib is shown having a particular shape, such as being rectangular and having right-angled corners, other shapes may be used as desired. The crib may also take the form of any desired size. While the panels have a slotted design with generally elongated oval openings, other panel designs may also be used. The illustrated embodiments show each of the sides having first and second side panels. However, embodiments may incorporate two or more side panels. While in the first embodiment, each of the first and second ends of the crib has an "end panel" that extends from the end at a right angle, alternative embodiments can be used without these end panels as the first and second side panels can be coupled directly to the crib ends, or by other connective parts. Also, while hinges and rails are specifically identified, other components, hardware, connectors, supports, and the like, that are otherwise suitable alternatives may also be used. Accordingly, the above description is intended to provide exemplary embodiments, and the scope the various embodiments disclosed is not to be limited by these specific examples provided.

Various embodiments of the disclosure could also include permutations of the various elements recited in the claims as if each dependent claim was a multiple dependent claim incorporating the limitations of each of the preceding dependent claims as well as the independent claims. Such permutations are expressly within the scope of this disclosure.

While the various embodiments have been particularly shown and described with reference to a number of embodiments, it would be understood by those skilled in the art that changes in the form and details may be made to the various embodiments disclosed herein without departing from the spirit and scope of the various embodiments disclosed herein and that the various embodiments disclosed herein are not intended to act as limitations on the scope of the claims. All references cited herein are incorporated in their entirety by reference.

The description the various embodiments has been presented for purposes of illustration and description, but is not intended to be exhaustive or limiting of the scope of the disclosure to the form disclosed. The scope the various embodiments disclosed is limited only by the scope of the following claims. Many modifications and variations will be apparent to those of ordinary skill in the art. The embodiment described and shown in the figures was chosen and described in order to best explain the principles of the disclosed embodiments, the practical application, and to enable others of ordinary skill in the art to understand the various embodiments with various modifications as are suited to the particular use contemplated.

What is claimed is:

1. A foldable crib movable between a folded position and an open position, the foldable crib comprising:

a first crib end;

a second crib end;

a first connecting member joining the first end to the second end, wherein the first connecting member is configured to be foldable;

a second connecting member joining the first end to the second end, wherein the second connecting member is configured to be foldable, and wherein in an open position the first connecting member and the second connecting member are generally unfolded and wherein in a folded position the first connecting member and the second connecting member are folded;

at least one removable edge rail configured to mate with the first connecting member or the second connecting member and maintain the first connecting member or the second connecting member in the open position;

a plurality of board support rails wherein at least one board support rail is attached to each of the first crib end, the second crib end, the first connecting member and the second connecting member; and a removable mattress board which may be placed into contact with each of the plurality of board support rails.

2. The foldable crib of claim 1, wherein the first connecting member includes two panels joined by one or more hinges and the second connecting member includes two panels joined by one or more hinges.

3. The foldable crib of claim 1, wherein the first connecting member includes two support beam segments joined by one or more hinges and the second connecting member includes two or more support beam segments joined by one or more hinges.

4. The foldable crib of claim 1 wherein the removable mattress board further comprises a hinged mattress board comprising at least two panels connected by a hinge, the two panels being foldable with respect to each other.

5. A foldable crib movable between a folded position and an open position, the foldable crib comprising:

a first end;

a second end joined to the first end by a first connecting member and a second connecting member, wherein the first connecting member includes a first side panel I and a first side panel II joined by a first panel hinge, and the second connecting member includes a second side panel I and a second side panel II joined by a second panel hinge, wherein the first connecting member is configured to fold inward when the first end is moved in the direction of the second end, and the second connecting member is configured to fold inward when the first end is moved in the direction of the second end;

wherein the foldable crib is in a folded position with the first connecting member and the second connecting member both folded inward, and the foldable crib is in an open position when the first connecting member and the second connecting member are substantially straight;

at least one removable edge rail configured to mate with the first connecting member or the second connecting member and maintain the first connecting member or the second connecting member in the open position;

a plurality of board support rails wherein at least one board support rail is attached to each of the first crib end, the second crib end, the first side panel I, the second side panel I, the first side panel II and the second side panel II; and a removable mattress board which may be placed into contact with each of the plurality of board support rails.

6. The foldable crib of claim 5, wherein in the folded position the first connecting member folds at the first panel hinge and the second connecting member folds at the second panel hinge, and in the open position, the first panel hinge is laterally offset from the second panel hinge.

7. The foldable crib of claim 5, further comprising a mattress board, wherein each of the first end, the second end, the first connecting member, and the second connecting member includes one or more mattress board support rails on the interior side of the crib, and the mattress board is configured to fit generally horizontally within the crib and engage the mattress board support rails.

8. The foldable crib of claim 5, further comprising a first edge rail and a second edge rail, wherein in the open position, the first connecting member has a first elongate top side edge and the second connecting member has a second elongated top side edge, and the first edge rail securely engages the first top side edge of the first connecting member and the second edge rail securely engages the second top side edge of the second connecting member.

9. The foldable crib of claim 5 wherein the removable mattress board further comprises a hinged mattress board comprising at least two panels connected by a hinge, the two panels being foldable with respect to each other.

10. A foldable crib movable between a folded position and an open position, the foldable crib comprising:

a first end having one or more crib legs for raising the foldable crib;

a second end having one or more crib legs for raising the foldable crib;

a first connecting member joining the first end to the second end, wherein the first connecting member includes a first side panel I and a first side panel II, the first side panel I foldably joined to the first side panel II at a first fold line;

a second connecting member joining the first end to the second end, wherein the second connecting member includes a second side panel I and a second side panel II, the second side panel I foldably joined to the second side panel II at a second fold line, and wherein in the open position, the first fold line and the second fold line are laterally offset a predetermined distance from each other;

wherein in the closed position, the first end and the second end are proximate to each other, and the first side panel I and first side panel II of the first connecting member form a first folded panel and the second side panel I and second side panel II of the second connecting member form a second folded panel, and the first folded panel and the second folded panel are nested within the crib proximate to each other between the first end and the second end;

at least one removable edge rail configured to mate with the first connecting member or the second connecting member and maintain the first connecting member or the second connecting member in the open position;

a plurality of board support rails wherein at least one board support rail is attached to each of the first crib end, the second crib end, the first side panel I, the second side panel I, the first side panel II and the second side panel II; and a removable mattress board which may be placed into contact with each of the plurality of board support rails.

11. The foldable crib of claim 10 wherein the removable mattress board further comprises a hinged mattress board comprising at least two panels connected by a hinge, the two panels being foldable with respect to each other.

* * * * *